US011878344B2

(12) United States Patent
Ma et al.

(10) Patent No.: US 11,878,344 B2
(45) Date of Patent: Jan. 23, 2024

(54) DIRECTIONALLY SOLIDIFIED HIGH-BORON AND HIGH-VANADIUM HIGH-SPEED STEEL AND METHOD FOR PREPARING SAME

(71) Applicant: XI'AN JIAOTONG UNIVERSITY, Xi'an (CN)

(72) Inventors: Shengqiang Ma, Xi'an (CN); Ping Lv, Xi'an (CN); Pengjia Guo, Xi'an (CN); Jiandong Xing, Xi'an (CN); Xu Tan, Xi'an (CN); Shasha Fu, Xi'an (CN)

(73) Assignee: XI'AN JIAOTONG UNIVERSITY, Xi'an (CN)

( * ) Notice: Subject to any disclaimer, the term of this patent is extended or adjusted under 35 U.S.C. 154(b) by 15 days.

(21) Appl. No.: 17/836,242

(22) Filed: Jun. 9, 2022

(65) Prior Publication Data

US 2022/0297180 A1 Sep. 22, 2022

(51) Int. Cl.

| | |
|---|---|
| ***B22D 27/04*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |
| ***C21C 7/06*** | (2006.01) |
| ***C22C 33/06*** | (2006.01) |

(Continued)

(52) U.S. Cl.

CPC ..... *B22D 27/045* (2013.01); *C21C 7/06* (2013.01); *C22C 33/06* (2013.01); *C22C 38/02* (2013.01); *C22C 38/04* (2013.01); *C22C 38/06* (2013.01); *C22C 38/22* (2013.01); *C22C 38/24* (2013.01); *C22C 38/28* (2013.01); *C22C 38/32* (2013.01); *B22D 29/00* (2013.01)

(58) Field of Classification Search

CPC ..... B22D 27/045; C21C 7/06; C22C 38/22; C22C 33/06

See application file for complete search history.

(56) References Cited

U.S. PATENT DOCUMENTS 3,437,131 A * 4/1969 Ornitz ..... B22D 13/102 164/33
2015/0299817 A1* 10/2015 Shimotsu ..... C21D 8/0294 148/566

FOREIGN PATENT DOCUMENTS

CN 101078090 * 11/2007
CN 100405510 * 7/2008
CN 101240402 A 8/2008

(Continued)

OTHER PUBLICATIONS

"Quenching Media" ASM Handbooks. vol. 4 1991. p. 67-120 (Year: 1991).*

(Continued)

*Primary Examiner* — Nicholas A Wang

(57) ABSTRACT

Disclosed are a high-boron high-vanadium high-speed steel and a method for preparing the same. Pig iron, scrap steel, ferrochromium, ferromanganese, ferroboron, ferrovanadium, industrial pure iron, ferromolybdenum, ferrotungsten, ferrosilicon and ferrotitanium are subjected to smelting at 1580-1600° C. and refining to obtain a liquid steel. The liquid steel is subjected to superheating, and directional solidification at a casting temperature of 1420-1430° C., and cooled to room temperature to obtain the directionally solidified high-speed steel.

7 Claims, 4 Drawing Sheets

(51) Int. Cl.
*C22C 38/24* (2006.01)
*B22D 29/00* (2006.01)

(56) References Cited

FOREIGN PATENT DOCUMENTS

| | | | | |
|---|---|---|---|---|
| CN | 102366830 | | * | 3/2012 |
| CN | 102626771 | | * | 8/2012 |
| CN | 108359916 | A | | 8/2018 |
| CN | 108842116 | | * | 11/2018 |
| CN | 111074142 | A | | 4/2020 |
| GB | 842951 | A | | 7/1960 |

OTHER PUBLICATIONS

Zhou Chenming, Li Yefeia, Yi Dawei, Ma Shengqiang, Liu Hong-gang; Study on abrasive wear properties of the directional solidificated Fe-B casting alloy; China Foundry Machinery & Technology, vol. 54 No. 5, Sep. 2019; State Key Laboratory for Mechanical Behavior of Materials, Xi'an Jiaotong University, Xi'an 710049, Shaanxi China.

* cited by examiner

DIRECTIONALLY SOLIDIFIED HIGH-BORON AND HIGH-VANADIUM HIGH-SPEED STEEL AND METHOD FOR PREPARING SAME

CROSS-REFERENCE TO RELATED APPLICATIONS

This application claims the benefit of priority from Chinese Patent Application No. 202110925617.4, filed on Aug. 12, 2021. The content of the aforementioned application, including any intervening amendments thereto, is incorporated herein by reference in its entirety.

TECHNICAL FIELD

This disclosure relates to the manufacturing of directionally solidified wear-resistant metal materials, and more particularly to a directionally solidified high-boron and high-vanadium high-speed steel and a method for preparing the same.

BACKGROUND

High-speed steel has been widely used as a wear-resistant metal material and tool steel. It is mainly composed of metal matrix and hard-phase carbides distributed over the metal matrix. The hard-phase carbides can enhance the wear resistance of the high-speed steel as the strengthening constitutes, and the metal matrix as a toughening phase contributes excellent stiffness and shock absorption to the high-speed steel. The high-speed steel is a heavily alloyed material, in which vanadium has a significant effect on the microstructure and properties of high-speed steel. For instance, vanadium can facilitate the formation of MC-type carbides and lamellar $M_2C$-type carbides, and inhibit the formation of skeletal $M_6C$-type carbides to enhance the wear resistance of the high-speed steel. The orientation of the hard phase (e.g., carbides or borides in steels) will significantly affect the overall performance of the metal material. Even for the same material, different hard phase orientations may alter the overall performance of the alloy. When suffering friction and wear, the change in the orientation of the wear-resistant phase in metal material will greatly alter the wear resistance of the material and other properties.

The matrix microstructure of the high-boron high-speed steel is usually composed of a martensitic matrix, on which a large number of high-hardness borocarbides or eutectic borides are distributed in a network. The high-boron high-speed steel has a high hardness owing the presence of these eutectic borides. Nevertheless, considering that the eutectic borocarbides or borides has large inherent brittleness and coarse morphology and size, and is distributed in a network on the matrix, the high boron high-speed steel is naturally brittle and hard, and thus the rolls manufactured therefrom are prone to peeling, cracking and wear.

SUMMARY

An object of the present disclosure is to provide a directionally solidified high-boron high-vanadium high-speed steel and a method for preparing the same to overcome deficiencies in the prior art. The method provided herein realizes the effective regulation to control of the size, shape and distribution of the borides and carbides in the high-speed steel, which can simultaneously achieve the desired microstructural orientation and the tailored strengthening and toughening of the high-boron high speed steel, as well as the coordination between the special microstructure orientation and excellent unique properties, greatly enhancing the service life and performance. This application offers a new idea and insight for developing wear-resistant high-boron high-speed steels.

Technical solutions of this disclosure are described as follows.

In a first aspect, this disclosure provides a method of preparing a directionally solidified high-speed steel, comprising:

(S1) subjecting a raw material to smelting at 1580-1600° C. and refining to obtain a liquid steel; wherein the raw material comprises pig iron, scrap steel, ferrochromium, ferromanganese, ferroboron, ferrovanadium, industrial pure iron, ferromolybdenum, ferrotungsten, ferrosilicon and ferrotitanium; and (S2) subjecting the liquid steel to superheating and directional solidification at a casting temperature of 1420-1430° C. followed by cooling to room temperature to obtain the directionally solidified high-speed steel.

In some embodiments, in step (S1), the raw material comprises 4.893-4.894% by weight of the pig iron, 25.176-25.177% by weight of the scrap steel, 8.520-8.521% by weight of the ferrochromium, 1.038-1.039% by weight of the ferromanganese, 10.899-10.900% by weight of the ferroboron, 4.148-4.149% by weight of the ferrovanadium, 41.850-41.860% by weight of the industrial pure iron, 1.121-1.122% by weight of the ferromolybdenum, 1.554-1.555% by weight of the ferrotungsten, 0.463-0.464% by weight of the ferrosilicon and 0.335-0.336% by weight of the ferrotitanium.

In some embodiments, in step (S1), the smelting and the refining are performed through steps of:

feeding the scrap steel, the pig iron and the industrial pure iron to a furnace, and then feeding the ferromolybdenum, the ferrochromium, the ferrotungsten, the ferrovanadium, the ferromanganese and the ferrosilicon to the furnace; heating the furnace to 1550-1600° C. to obtain a first melt; transferring the first melt to a ladle; feeding the preheated ferroboron and the ferrotitanium to the furnace and then transferring the first melt in the ladle back to the furnace to obtain a second melt; transferring the second melt to the ladle; introducing 0.148-0.152 g of an aluminum filament to a bottom of the furnace for deoxidization; transferring the second melt with the desired chemical composition requirements back to the furnace; and performing argon blowing at the bottom of the furnace for 8-15 min for refining.

In some embodiments, the directional solidification is performed in a directional solidification device equipped with a sodium silicate-bonded sand mold as a cast mould; an inner side surface of the sodium silicate-bonded sand mold is coated with an aluminum oxide coating with an average thickness of 0.8-1.1 mm so as to prevent side wall heat dissipation.

In some embodiments, in step (S2), before the directional solidification, the sodium silicate-bonded sand mold is dried at 250-280° C. for 6-8 h.

In some embodiments, in step (S2), the superheating of the liquid steel is performed at 1510-1520° C. for 10-12 min with a superheat degree of 49.8-50.2° C.

In some embodiments, in step (S2), a top end of a casting riser of the directional solidification device is spread with a thermal insulating agent to maintain the thermal insulation; thus, according to the directional solidification device mentioned above, the whole directional solidification device can ensure a Y-type ingot (as shown in FIG. 1) with a heat dissipation producing a one-way heat extraction established as the strong heat gradient from casting mould to a chiller creating a cooling condition; the directional solidification is performed at a cooling rate of 12.1-12.3° C./s for 19.0-21.0 s; and after the Y-type ingot is cooled to room temperature, the directionally solidified high-speed steel is subjected to mold dismantling, shakeout and wire cutting.

In some embodiments, the directional solidification device adopts a thermal-couple for heating monitor, and a pure ion block embedded with a copper block as a chiller for cooling.

In some embodiments, the casting mould of the directional solidification device is coated with the aluminum oxide coating layer having a thickness of 0.8-1.1 mm.

In a second aspect, this disclosure provides a directionally solidified high-boron high-vanadium high-speed steel, comprising:

a metal matrix; and a hard-phase boride distributed on the metal matrix;

wherein the directionally solidified high-speed steel consists of 0.35-0.48% by weight of C, 1.77-1.82% by weight of B, 4.76-4.81% by weight of Cr, 0.58-0.73% by weight of Si, 0.64-0.90% by weight of Mn, 1.19-1.23% by weight of W, 0.63-0.67% by weight of Mo, 0.06-0.10% by weight of Ti, 0.59-0.61% by weight of Al, 1.88-2.30% by weight of V, balance with Fe and trace impurities.

Compared with the prior art, the beneficial effects of the present disclosure are described below.

With respect to the method provided herein for preparing a directionally solidified high-boron high-vanadium high-speed steel, the sodium silicate-bonded sand mold is subjected to drying and thermal insulation prior to the casting, and the raw materials are subjected to smelting, refining and thermal insulation treat of the liquid steel (namely melt). In this way, individual phases in the steel are refined, and various defects and inclusions in the casting process can be alleviated or almost eliminated. Moreover, the yield of casting elements is improved. The casting and directional solidification of the purified melt in the directional solidification device is subject to one-way heat extraction as the thermal conductivity control to obtain the excellent casting or ingot with dense and fine microstructure while ensuring that the casting microstructure is orderly arranged along the solidification direction. As a result, the grain orientation of the microstructure is well controlled, and the distribution of the columnar grains and grain boundary is optimized. The casting prepared by the method of the disclosure has excellent resistance to thermal shock and oxidation, extended fatigue life and desired resistance to high temperature creep. In order to promote the directional microstructure in the steel, the vanadium-boron composition design, melt superheating treatment, refinement, and control and monitor the one-way heat extraction of directional solidification are integrated. With respect to the resulting directionally solidified high-boron high-vanadium high-speed steel, the microhardness of the boride increases with the increase of vanadium content in different crystal growth orientations of borides. In particular, in the presence of 2.05 wt. % vanadium, the bulk hardness of directionally solidified high-boron high-vanadium high-speed steel in the growth plane of the borides (namely $M_2B$ boride (002) plane as its preferred growth plane) reaches the maximum value of 62.1 HRC, which is 13.04% higher than that of the as-cast ordinary solidification high-boron high-speed steel, and 35.42% higher than that of the as-cast ordinary solidification high-boron high-speed steel bearing 0.4% by weight of C, 2.0% by weight of B, and 1.0% by weight of V (e.g., 40.1 HRC). At the same time, the toughness of the directionally solidified high-boron high-vanadium high-speed steel is improved by 32%. In addition, the bending strength of the directionally solidified high-boron high-vanadium high-speed steel is also enhanced with the increase of the vanadium content, and when the vanadium content is 2.05 wt. %, the bending strength of the directionally solidified high-boron high-vanadium high-speed steel parallel to the preferred growth orientation (i.e., $Fe_2B$ or $M_2B$ [002] orientation) reaches the maximum 1724 MPa, which is 12.41% higher than that of the as-cast ordinary solidification high-speed steel.

By regulating the raw material composition, a high-boron high-vanadium high-speed steel casting with 1.88-2.30% by weight of vanadium and other elements meeting the specifications can be obtained, which has enhanced strength and toughness. In the case of increased vanadium content and lowered boron content, the fracture strength, toughness and orientation effect are simultaneously enhanced.

The scrap steel, pig iron and industrial pure iron are fed to the furnace ahead of the ferromolybdenum, ferrochromium, ferrotungsten, ferrovanadium, ferromanganese and ferrosilicon to form a first melt, and the melting temperature and reaction time of the liquid steel containing various several elements are adjusted to control the compositional content of the liquid steel to a reasonable range. After that, the first melt is transferred to a ladle, and simultaneously, the pre-heated ferroboron and ferrotitanium are fed to the bottom of furnace to be molten uniformly. Subsequently, the first melt in the ladle is transferred to the furnace to obtain a second melt, and the second melt is transferred to the ladle. When the second melt in the ladle is close to 1520-1530° C., some aluminum filaments are fed to the bottom of the furnace for deoxidization, and then the second melt in the ladle is transferred back to the furnace. Argon blowing is performed at the bottom of the furnace to remove oxides and other inclusion impurities in the second melt to enable the refinement and purification, eliminating the casting defects and controlling the metallurgical quality. In the method provided herein, the smelting process is performed at 1580-1600° C., higher than the melting point of iron (1534° C.), so that the raw materials can be molten rapidly to ensure the full stirring and melting, enhancing the refinement and purification effect.

Further, the coating layer of the casting mold is 0.8-1.1 mm in thickness, which can mitigate the thermal impact of the high-temperature liquid steel on the casting mold and reduce the internal stress of the arm, preventing the casting from cracking. Moreover, the coating layer with such thickness can also play an important role in improving the heat insulation which ensure the one-way heat extraction as the thermal conductivity control to avoid the heat dissipation of the side wall of the mold.

Before the casting, the sodium silicate-bonded sand mold is dried at 250-280° C. for 6-8 h to prevent the gas evolution during the casting, avoiding the defects in the casting such as strength decline and pores. In this case, when the liquid steel is poured into the cavity formed by the directional solidification device, the side of the cavity hardly affects the heat dissipation, and finally a strong unidirectional heat dissipation condition is formed from top to bottom.

Further, the molten high-boron high-vanadium high-speed steel is kept at 1510-1520° C., higher than the melting point of iron, for 10-12 min to stay liquid and reach the complete mixing and uniform distribution of various elements, which facilitates avoiding the segregation. Furthermore, the casting temperature is 1410-1440° C., slightly higher than the liquidus temperature (1381° C.) in the phase diagram of the Fe—B alloy, which can maintain a certain degree of superheat to ensure the casting quality.

Further, in the presence of a thermal insulating agent, the cooling of the casting is accelerated, and a desired temperature gradient is reached to form the ideal directionally solidified columnar crystal microstructure and enable the good filling, the excellent feeding conditions and the easy healing of thermal crack, facilitating the manufacturing of dense and sound castings.

Further, a composite cooling system, formed by a pure ion block and a small square copper block closely embedded in the bottom thereof, is employed in the directional solidification device, which accelerates the cooling of the casting and offers the desired temperature gradient to form the ideal directionally solidified columnar crystal microstructure The directional solidification technique is performed at a cooling rate of 12.1-12.3° C./s for 19.0-21.0 s to ensure the good filling capacity, excellent feeding conditions and easy healing of the thermal crack, such that the obtained casting is dense and sound. Additionally, the coating layer of the directional solidification device is set to 0.8-1.1 mm in thickness, which can alleviate the heat impact of the high-temperature liquid steel on the casting mold and reduce the internal stress of the arm, preventing the obtained casting from cracking. The coating layer also strongly contributes to the heat insulation and the improvement of the filling performance of the casting mold.

The boron and vanadium-bearing high-speed steel provided in this application has a good orientation effect, in which a columnar dendritic microstructure is formed, and the horizontal grain boundary is eliminated, improving the resistance to high temperature creep and fatigue. When the vanadium content is 2.05 wt. %, the alloy has an evenly distributed hard phase, a fine and dense microstructure and optimal orientation effect and vanadium refinement effect, and is free of segregation. The minimum primary dendrite arm spacing and the secondary dendrite arm spacing of the alloy columnar crystal are 220 μm and 20 μm, respectively, which are reduced by 52.38% and 44.45%, respectively, compared with those of the high-boron vanadium-free high-speed steel.

In summary, by means of the directional solidification process, the grain orientation of the solidified microstructure can be better controlled such that the high-speed steel presents a certain orientation and has a continuous columnar crystal structure, allowing for greatly improved performance compared with the ordinary high-boron high-speed steel.

The technical solutions of the present application will be further described in detail below with reference to the accompanying drawings and embodiments.

DETAILED DESCRIPTION OF EMBODIMENT

Figure 1:
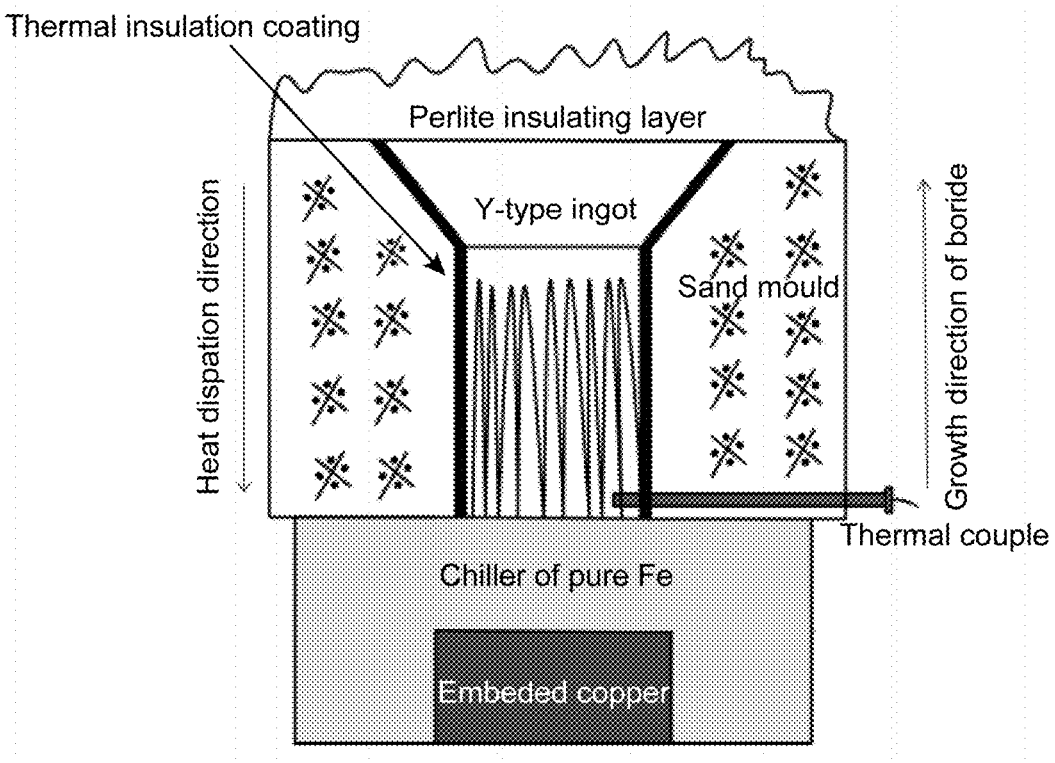
FIG. 1 schematically depicts a directional solidification device according to an embodiment of the present disclosure.
Figure 2A:
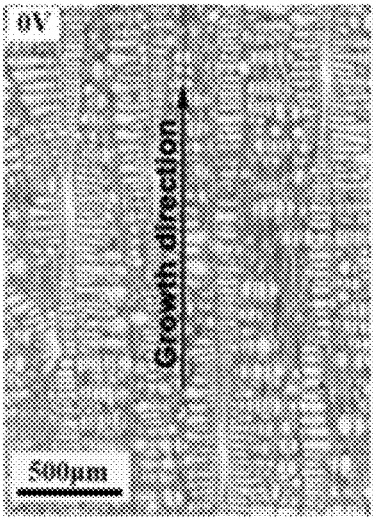
FIGS. 2*a*-2*f* shows optical microscopy (OM) topographic images of directionally solidified high-boron high-vanadium high-speed steels containing different levels of vanadium, where (a): 0 wt. % V under lower magnification; (b): 1 wt. % V under lower magnification; (c): 2 wt. % V under lower magnification; (d): 0 wt. % V under higher magnification; (e): 1 wt. % V under higher magnification; and (f): 2 wt. % V under higher magnification.
Figure 2B:
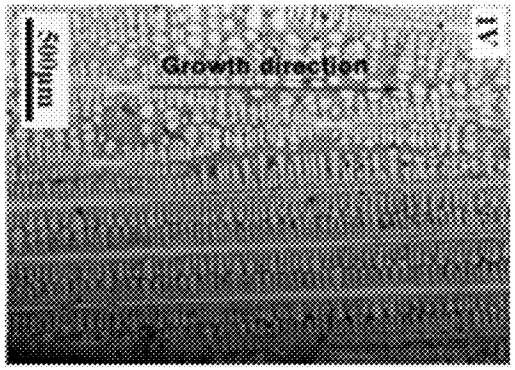
Figure 2C:
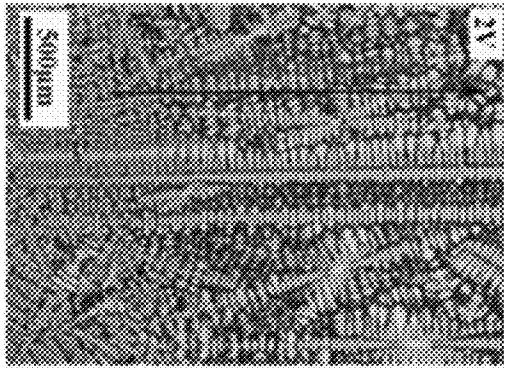
Figure 2D:
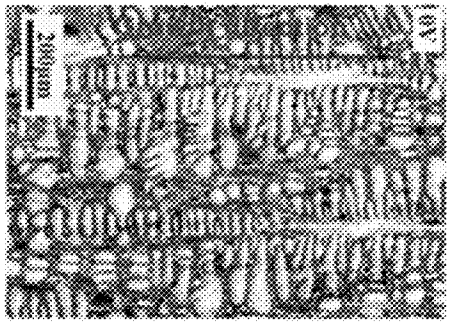
Figure 2E:
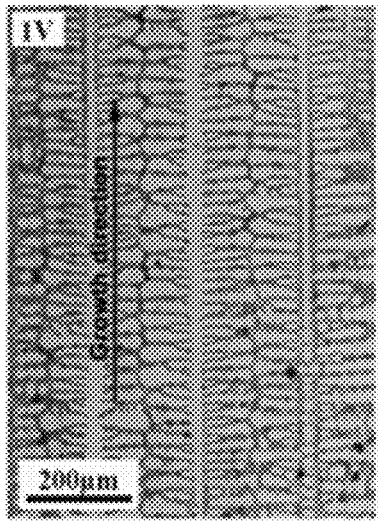
Figure 2F:
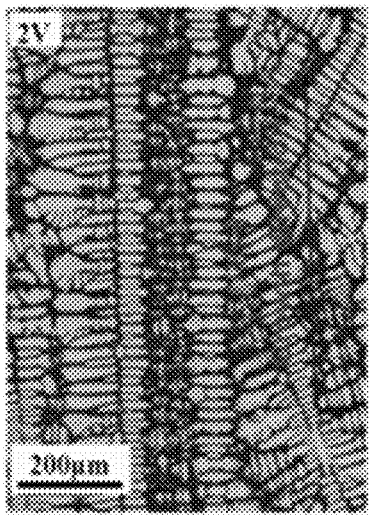

The present disclosure provides a directionally solidified high-boron and high-vanadium high-speed steel and a method for preparing the same. The resulting directionally solidified vanadium-containing high-boron high-speed steel has well-oriented hard phase (i.e., $M_2B$ borides), uniform and dense microstructure, large hardness and high bending strength, and is low-cost, stable, and free of segregation. The method provided herein provides a new idea for developing the wear-resistant high-speed steel.

Provided herein is a directionally solidified high-boron high-vanadium high-speed steel, consisting of 0.35-0.48% by weight of C, 1.77-1.82% by weight of B, 4.76-4.81% by weight of Cr, 0.58-0.73% by weight of Si, 0.64-0.90% by weight of Mn, 1.19-1.23% by weight of W, 0.63-0.67% by weight of Mo, 0.06-0.10% by weight of Ti, 0.59-0.61% by weight of Al, 1.88-2.30% by weight of V, and Fe and trace impurities.

The directionally solidified high-boron and high-vanadium high-speed steel includes a metal substrate and a hard-phase boride distributed on the metal substrate. Vanadium significantly contributes to the wear resistance and red hardness of high-speed steel materials, and is a strong carbide forming element. The vanadium in the high-speed steel is partially dissolved in the matrix, and partly forms a carbide with high hardness and high thermal stability. The increase of vanadium content is accompanied by the change of the boride in the alloy from rod-like to multi-granular, and continuous decline in the primary dendrite arm spacing and the secondary dendrite arm spacing of the columnar crystal of the directionally solidified alloy matrix.

When the vanadium content is 2.05 wt. %, the alloy has an evenly distributed hard phase and a fine structure without segregation, and shows the best orientation effect and vanadium refinement effect. The minimum primary dendrite arm spacing and the secondary dendrite arm spacing of the alloy columnar crystal are 220 μm and 20 μm, respectively, which are reduced by 52.38% and 44.45%, respectively, compared with those of the high-boron vanadium-free high-speed steel.

The hardness test results demonstrate that the bulk hardness of the alloy increases with the increase of vanadium content. In particular, in the presence of 2.05 wt. % vanadium, the bulk hardness of the steel in the growth plane of the borides (namely $M_2B$ boride (002) plane as its preferred growth plane) reaches the maximum 62.1 HRC, which is 13.04% higher than that of the as-cast high-boron high-speed steel, and 35.42% higher than that of the as-cast high-boron high-speed steel bearing 0.4% by weight of C, 2.0% by weight of B, and 1.0% by weight of V (40.1 HRC). At the same time, the toughness of the alloy is improved by 32%. In addition, the bending strength of the alloy is also enhanced with the increase of the vanadium content, and when the vanadium content is 2.05 wt. %, the bending strength of the directionally solidified high-boron high-vanadium high-speed steel parallel to the preferred growth orientation (i.e., $Fe_2B$ or $M_2B$ [002] orientation) reaches the maximum 1724 MPa, which is 12.41% higher than that of the as-cast high-speed steel.

As an important addition element in high-boron high-speed steels, boron mainly plays a key role in forming various high-hardness and high-thermal stability borides with alloying elements. At the same time, the hardenability of the alloy can be enhanced under the dissolution of a slight amount of boron in the substrate. In the presence of 1.77-1.82 wt. % of boron, the microstructure is allowed to have better performance.

A method for preparing the directionally solidified high-speed steel is also provided herein, which is specifically described below.

(S1) Raw materials are subjected to smelting in a furnace to obtain a liquid steel, which is transferred with a ladle. Then 0.148-0.152 g of aluminum filaments are fed to the bottom of the furnace to perform deoxidation. After that, the liquid steel in the ladle is returned to the furnace and subjected to refining via argon blowing at the bottom of the furnace for 8-15 min to obtain the qualified and clean molten high-boron high-vanadium high speed steel.

In an embodiment, the raw materials in step (S1) include 25.176-25.177% by weight of the scrap steel, 41.850-41.860% by weight of the industrial pure iron, 1.038-1.039% by weight of the ferromanganese, 0.463-0.464% by weight of the ferrosilicon, 4.893-4.894% by weight of the pig iron, 8.520-8.521% of the ferrochromium, 10.899-10.900% by weight of the ferroboron, 1.554-1.555% by weight of the ferrotungsten, 1.121-1.122% by weight of the ferromolybdenum, 4.148-4.149% by weight of the ferrovanadium, and 0.335-0.336% by weight of the ferrotitanium.

In an embodiment, before the casting, the sodium silicate-bonded sand mold is dried at 250-280° C. for 6-8 h to prevent the gas evolution during the casting, avoiding the defects in the casting such as strength decline and pores. In this case, when the liquid steel is poured into the cavity formed by the directional solidification device, the side of the cavity hardly affects the heat dissipation, and finally a strong unidirectional heat dissipation condition is formed from top to bottom.

In an embodiment, the scrap steel, the pig iron and the industrial pure iron, the ferromolybdenum, the ferrochromium, the ferrotungsten, the ferrovanadium, the ferromanganese and the ferrosilicon are fed to a furnace in sequence and molten to obtain a first melt, and this process is accompanied by a series of oxidation reactions, such that levels of individual elements are reduced to a reasonable range. The first melt is transferred to a ladle, and at the same time, the ferroboron, the ferrotitanium are fed to the furnace to be molten, and then the first melt in the ladle is transferred back to the furnace to obtain a second melt, which is then transferred to the ladle. When the second melt in the ladle is close to 1520-1530° C., some aluminum filaments are fed to the bottom of the furnace to perform deoxidization, and then the second melt is transferred back to the furnace, and subjected to refining by argon blowing at the bottom of the furnace. By means of the refining and standing, the impurities, oxides and other inclusions in the liquid steel are removed, further improving the refining degree and purity of the liquid steel, eliminating the casting defects and controlling the metallurgical quality.

In an embodiment, the smelting process is performed at 1580-1600° C., higher than the melting point of iron 1534° C., so that the raw materials can be molten rapidly to enable the full stirring and melting, facilitating enhancing the refinement quality.

(S2) The liquid steel obtained in step (S1) is subjected to superheating treatment at 1510-1520° C. with a superheating degree of 49.8-50.2° C., and poured into the directional solidification device, where a top end of the casting riser of the directional solidification device is spread with high-purity perlite. After cooled to room temperature, the resulting solidified product is subjected to mold dismantling, shakeout, wire cutting, and finishing to obtain the finished high-speed steel product.

In an embodiment, the overheating treatment is performed at 1510-1520° C. (higher than the melting point of iron) for 10-12 min such that the melt can stay liquid and can be mixed completely, enabling the uniform distribution of elements and avoiding segregation.

In an embodiment, the coating layer of the casting mould is 0.8-1.1 mm in thickness, which can mitigate the thermal impact of the high-temperature liquid steel on the casting mould and reduce the internal stress of the arm, preventing the casting from cracking. Moreover, the coating layer with such thickness can also play a role in improving the heat insulation and the filling performance of the casting mold.

In an embodiment, the casting temperature is 1410-1440° C., higher than the liquidus temperature (1381° C.) in the phase diagram of the Fe—B alloy, which can maintain certain superheat to ensure high quality casting.

Before casting, skimming and deoxidation are performed, and an insulation agent (high-purity perlite) is spread uniformly on the insulating riser of the directional solidification device. The solidification is performed at a cooling rate of 12.1-12.3° C./s for 19.0-21.0 s to ensure the good filling capacity, excellent feeding conditions and easy healing of the thermal crack, such that the obtained casting is dense and sound.

In the directional solidification device, four lateral thermal-couples are built into the same level 5 mm away from the bottom of the cold end, and a cooling system formed by embedding a small square copper block in the bottom of the square pure iron. The square pure iron is 300 mm×300 mm×300 mm in size, and the built-in copper block is 150 mm×150 mm×200 mm in size arranged at the bottom centerline 100 mm away from the top surface of the pure iron. The pure iron is closely matched with the copper block, which improves the cooling rate of the casting such that the casting obtains the necessary temperature gradient to form an ideal directional solidification columnar crystal structure.

To render objects, technical solutions and advantages of the embodiments of the present disclosure clearer, the technical solutions of the present application will be clearly and completely described below with reference to the drawings of the embodiments. Obviously, described below are only some embodiments of the present application. The components of the embodiments typically illustrated in the drawings may be arranged and designed in different configurations. Accordingly, the following detailed description of the embodiments illustrated in the drawings is not intended to limit the scope of the application, but merely illustrative of the selected embodiments. Based on the embodiments provided herein, other embodiments obtained by those skilled in the art without paying any creative effort shall fall within the scope of this application.

Example 1

The raw material for the preparation of a directionally solidified high-speed steel included 25.176% by weight of a scrap steel, 41.852% by weight of an industrial pure iron, 1.038% by weight of a ferromanganese, 0.463% by weight of a ferrosilicon, 4.893% by weight of a pig iron, 8.520% by weight of a ferrochromium, 10.900% by weight of a ferroboron, 1.554% by weight of a ferrotungsten, 1.121% by weight of a ferromolybdenum, 4.148% by weight of a ferrovanadium, and 0.335% by weight of a ferrotitanium.

The scrap steel was composed of 0.300% by weight of C, 0.300% by weight of Si, 0.500% by weight of Mn, and Fe. The industrial pure iron was composed of 0.003% by weight of C, 0.020% by weight of Si, 0.150% by weight of Mn, and Fe. The ferromanganese was composed of 6.410% by weight of C, 1.630% by weight of Si, 65.900% by weight of Mn, and Fe. The ferrosilicon was composed of 0.100% by weight of C, 73.100% by weight of Si, and Fe. The pig iron was composed of 4.270% by weight of C, 0.900% by weight of Si, 0.113% by weight of Mn, and Fe. The ferrochromium was composed of 0.240% by weight of C, 59.000% by weight of Cr, 1.700% by weight of Si, and Fe. The ferroboron was composed of 0.320% by weight of C, 0.760% by weight of Si, 18.150% by weight of B, and Fe. The ferrotungsten was composed of 0.060% by weight of C, 0.290% by weight of Si, 0.160% by weight of Mn, 78.507% by weight of W, and Fe. The ferromolybdenum was composed of 0.034% by weight of C, 0.750% by weight of Si, 62.597% by weight of Mo, and Fe. The ferrovanadium was composed of 0.310% by weight of C, 1.010% by weight of Si, 51.896% by weight of V, and Fe. The ferrotitanium was composed of 0.002% by weight of C, 0.015% by weight of Si, 30.009% by weight of Ti, and Fe.

The directionally solidified high-boron high-vanadium high-speed steel was prepared as follows.

(S1) The scrap steel, the pig iron, the industrial pure iron, the ferromolybdenum, the ferrochromium, the ferrotungsten, the ferrovanadium, the ferromanganese and the ferrosilicon were fed to a furnace in sequence and molten to obtain a first melt, which was transferred to a ladle. When the furnace was heated to 1550° C., the ferroboron and ferrotitanium were fed to the furnace and molten, and the first melt in the ladle was transferred back to the furnace to obtain a second melt, which was then transferred to the ladle. After that, 0.148 g of aluminum filament was fed to a bottom of the furnace to perform deoxidization, and then the second melt in the ladle was transferred back to the furnace and subjected to refinement by argon blowing at the bottom of the furnace for 10 min to obtain a liquid steel, which was confirmed to be qualified and clean. Subsequently, the liquid steel was subjected to superheating treatment at 1510° C. for 10 min with a superheating degree of 49.8° C. Before casting, the sodium silicate-bonded sand mold was dried at 250° C. for 6 h.

(S2) The liquid steel obtained in step (S1) was poured into the directional solidification device at a temperature of 1420° C. for directional solidification, where the temperature measurement was enabled by means of a thermal couple, and a chilling block formed by embedding a copper block in a pure iron was employed for cooling; and a thickness of a coating layer was 0.8 mm. Before the casting, skimming and deoxidation were performed, and a thermal insulation agent (high-purity perlite) was spread uniformly on the casting riser of the directional solidification device. The solidification was performed at a cooling rate of 12.1° C./s for 19.0 s. After cooled to room temperature, the resulting solidified product was subjected to mold dismantling, shakeout, wire cutting, and finishing to obtain the directionally solidified high-boron and high-vanadium high-speed steel.

Example 2

The raw material for the preparation of a directionally solidified high-speed steel included 25.176% by weight of a scrap steel, 41.852% by weight of an industrial pure iron, 1.038% by weight of a ferromanganese, 0.463% by weight of a ferrosilicon, 4.893% by weight of a pig iron, 8.520% by weight of a ferrochromium, 10.899% by weight of a ferroboron, 1.554% by weight of a ferrotungsten, 1.121% by weight of a ferromolybdenum, 4.148% by weight of a ferrovanadium, and 0.335% by weight of a ferrotitanium.

The scrap steel was composed of 0.300% by weight of C, 0.300% by weight of Si, 0.500% by weight of Mn, and Fe. The industrial pure iron was composed of 0.300% by weight of C, 0.020% by weight of Si, 0.150% by weight of Mn, and the Fe. The ferromanganese was composed of 6.410% by weight of C, 1.630% by weight of Si, 65.900% by weight of Mn, and Fe. The ferrosilicon was composed of 0.100% by weight of C, 73.100% by weight of Si, and Fe. The pig iron was composed of 4.270% by weight of C, 0.900% by weight of Si, 0.113% by weight of Mn, and Fe. The ferrochromium was composed of 0.240% by weight of C, 58.809% by weight of Cr, 1.700% by weight of Si, and Fe. The ferroboron was composed of 0.320% by weight of C, 0.760% by weight of Si, 18.554% by weight of B, and Fe. The ferrotungsten was composed of 0.060% by weight of C, 0.290% by weight of Si, 0.160% by weight of Mn, 79.150% by weight of W, and Fe. The ferromolybdenum was composed of 0.034% by weight of C, 0.750% by weight of Si, 62.914% by weight of Mo, and Fe. The ferrovanadium was composed of 0.310% by weight of C, 1.010% by weight of Si, 52.020% by weight of V, and Fe. The ferrotitanium was composed of 0.002% by weight of C, 0.015% by weight of Si, 3.167% by weight of Ti, and Fe.

The directionally solidified high-speed steel was prepared as follows.

(S1) The scrap steel, the pig iron, the industrial pure iron, the ferromolybdenum, the ferrochromium, the ferrotungsten, the ferrovanadium, the ferromanganese and the ferrosilicon were fed to a furnace in sequence and molten to obtain a first melt, which was transferred to a ladle. When the furnace was heated to 1560° C., the ferroboron and ferrotitanium were fed to the furnace and molten, and the first melt in the ladle was transferred back to the furnace to obtain a second melt, which was then transferred to the ladle. After that, 0.149 g of the aluminum filament was fed to a bottom of the furnace to perform deoxidization, and then the second melt in the ladle was transferred back to the furnace and subjected to refinement by argon blowing at the bottom of the furnace for 8 min to obtain a liquid steel, which was confirmed to be qualified and clean. Subsequently, the liquid steel was subjected to superheating treatment at 1510° C. for 10 min with a superheating degree of 49.8° C. Before casting, the sodium silicate-bonded sand mold was dried at 260° C. for 6 h.

(S2) The liquid steel obtained in step (S1) was poured into the directional solidification device at a temperature of 1425° C. for directional solidification, where the temperature measurement was enabled by means of a thermal couple, and a chilling block formed by embedding a copper block in a pure iron was employed for cooling; and a thickness of a coating layer was 0.9 mm. Before the casting, skimming and deoxidation were performed, and a thermal insulation agent (high-purity perlite) was spread uniformly on the casting riser of the directional solidification device. The solidification was performed at a cooling rate of 12.1° C./s for 19.5 s. After cooled to room temperature, the resulting solidified product was subjected to mold dismantling, shakeout, wire cutting, and finishing to obtain the directionally solidified high-boron and high-vanadium high-speed steel.

Example 3

The raw material for the preparation of a directionally solidified high-speed steel included 25.176% by weight of a scrap steel, 41.851% by weight of an industrial pure iron, 1.038% by weight of a ferromanganese, 0.463% by weight of a ferrosilicon, 4.893% by weight of a pig iron, 8.521% by weight of a ferrochromium, 10.899% by weight of a ferroboron, 1.554% by weight of a ferrotungsten, 1.121% by weight of a ferromolybdenum, 4.148% by weight of a ferrovanadium, and 0.336% by weight of a ferrotitanium.

The scrap steel was composed of 0.300% by weight of C, 0.300% by weight of Si, 0.500% by weight of Mn, and Fe. The industrial pure iron was composed of 0.300% by weight of C, 0.020% by weight of Si, 0.150% by weight of Mn, and the Fe. The ferromanganese was composed of 6.410% by weight of C, 1.630% by weight of Si, 65.900% by weight of Mn, and Fe. The ferrosilicon was composed of 0.100% by weight of C, 73.100% by weight of Si, and Fe. The pig iron was composed of 4.270% by weight of C, 0.900% by weight of Si, 0.113% by weight of Mn, and Fe. The ferrochromium was composed of 0.240% by weight of C, 59.000% by weight of Cr, 1.700% by weight of Si, and Fe. The ferroboron was composed of 0.320% by weight of C, 0.760% by weight of Si, 18.146% by weight of B, and Fe. The ferrotungsten was composed of 0.060% by weight of C, 0.290% by weight of Si, 0.160% by weight of Mn, 79.150% by weight of W, and Fe. The ferromolybdenum was composed of 0.034% by weight of C, 0.750% by weight of Si, 61.000% by weight of Mo, and Fe. The ferrovanadium was composed of 0.310% by weight of C, 1.010% by weight of Si, 52.020% by weight of V, and Fe. The ferrotitanium was composed of 0.002% by weight of C, 0.015% by weight of Si, 26.460% by weight of Ti, and Fe.

The directionally solidified high-speed steel was prepared as follows.

(S1) The scrap steel, the pig iron, the industrial pure iron, the ferromolybdenum, the ferrochromium, the ferrotungsten, the ferrovanadium, the ferromanganese and the ferrosilicon were fed to a furnace in sequence and molten to obtain a first melt, which was transferred to a ladle. When the furnace was heated to 1570° C., the ferroboron and ferrotitanium were fed to the furnace and molten, and the first melt in the ladle was transferred back to the furnace to obtain a second melt, which was then transferred to the ladle. After that, 0.15 g of the aluminum filament was fed to a bottom of the furnace to perform deoxidization, and then the second melt in the ladle was transferred back to the furnace and subjected to refinement by argon blowing at the bottom of the furnace for 12 min to obtain a liquid steel, which was confirmed to be qualified and clean. Subsequently, the liquid steel was subjected to superheating treatment at 1510° C. for 10 min with a superheating degree of 50° C. Before casting, the sodium silicate-bonded sand mold was dried at 265° C. for 7 h.

(S2) The liquid steel obtained in step (S1) was poured into the directional solidification device at a temperature of 1430° C. for directional solidification, where the temperature measurement was enabled by means of a thermal couple, and a chilling block formed by embedding a copper block in a pure iron was employed for cooling; and a thickness of a coating layer was 0.8-1.1 mm. Before the casting, skimming and deoxidation were performed, and a thermal insulation agent (high-purity perlite) was spread uniformly on the casting riser of the directional solidification device. The solidification was performed at a cooling rate of 12.2° C./s for 20.0 s. After cooled to room temperature, the resulting solidified product was subjected to mold dismantling, shakeout, wire cutting, and finishing to obtain the directionally solidified high-boron and high-vanadium high-speed steel.

Example 4

The raw material for the preparation of a directionally solidified high-speed steel included 25.176% by weight of a scrap steel, 41.850% by weight of an industrial pure iron, 1.038% by weight of a ferromanganese, 0.464% by weight of a ferrosilicon, 4.894% by weight of a pig iron, 8.520% by weight of a ferrochromium, 10.899% by weight of a ferroboron, 1.554% by weight of a ferrotungsten, 1.121% by weight of a ferromolybdenum, 4.148% by weight of a ferrovanadium, and 0.336% by weight of a ferrotitanium.

The scrap steel was composed of 0.300% by weight of C, 0.300% by weight of Si, 0.500% by weight of Mn, and Fe. The industrial pure iron was composed of 0.300% by weight of C, 0.020% by weight of Si, 0.150% by weight of Mn, and Fe. The ferromanganese was composed of 6.410% by weight of C, 1.630% by weight of Si, 65.900% by weight of Mn, and Fe. The ferrosilicon was composed of 0.100% by weight of C, 73.100% by weight of Si, and the weight of Fe. The pig iron was composed of 4.270% by weight of C, 0.900% by weight of Si, 0.113% by weight of Mn, and Fe. The ferrochromium was composed of 0.240% by weight of C, 59.300% by weight of Cr, 1.700% by weight of Si, and Fe. The ferroboron was composed of 0.320% by weight of C, 0.760% by weight of Si, 18.350% by weight of B, and Fe. The ferrotungsten was composed of 0.060% by weight of C, 0.290% by weight of Si, 0.160% by weight of Mn, 78.507% by weight of W, and Fe. The ferromolybdenum was composed of 0.034% by weight of C, 0.750% by weight of Si, 60.097% by weight of Mo, and Fe. The ferrovanadium was composed of 0.310% by weight of C, 1.010% by weight of Si, 49.739% by weight of V, and Fe. The ferrotitanium was composed of 0.002% by weight of C, 0.015% by weight of Si, 31.954% by weight of Ti, and Fe.

The directionally solidified high-speed steel was prepared as follows.

(S1) The scrap steel, the pig iron, the industrial pure iron, the ferromolybdenum, the ferrochromium, the ferrotungsten, the ferrovanadium, the ferromanganese and the ferrosilicon were fed to a furnace in sequence and molten to obtain a first melt, which was transferred to a ladle. When the furnace was heated to 1580° C., the ferroboron and ferrotitanium were fed to the furnace and molten, and the first melt in the ladle was transferred back to the furnace to obtain a second melt, which was then transferred to the ladle. After that, 0.151 g of the aluminum filament was fed to a bottom of the furnace to perform deoxidization, and then the second melt in the ladle was transferred back to the furnace and subjected to refinement by argon blowing at the bottom of the furnace for 14 min to obtain a liquid steel, which was confirmed to be qualified and clean. Subsequently, the liquid steel was subjected to superheating treatment at 1510° C. for 12 min with a superheating degree of 50.1° C. Before casting, the sodium silicate-bonded sand mold was dried at 270° C. for 8 h.

(S2) The liquid steel obtained in step (S1) was poured into the directional solidification device at a temperature of 1435° C. for directional solidification, where the temperature measurement was enabled by means of a thermal couple, and a chilling block formed by embedding a copper block in a pure iron was employed for cooling; and a thickness of a coating layer was 1.0 mm. Before the casting, skimming and deoxidation were performed, and a thermal insulation agent (high-purity perlite) was spread uniformly on the casting riser of the directional solidification device. The solidification was performed at a cooling rate of 12.3° C./s for 21.0 s. After cooled to room temperature, the resulting solidified product was subjected to mold dismantling, shakeout, wire cutting, and finishing to obtain the directionally solidified high-boron and high-vanadium high-speed steel.

Example 5

The raw material for the preparation of a directionally solidified high-speed steel included 25.176% by weight of a scrap steel, 41.850% by weight of an industrial pure iron, 1.038% by weight of a ferromanganese, 0.464% by weight of a ferrosilicon, 4.894% by weight of a pig iron, 8.521% by weight of a ferrochromium, 10.899% by weight of a ferroboron, 1.554% by weight of a ferrotungsten, 1.121% by weight of a ferromolybdenum, 4.148% by weight of a ferrovanadium, and 0.335% by weight of a ferrotitanium.

The scrap steel was composed of 0.300% by weight of C, 0.300% by weight of Si, 0.500% by weight of Mn, and Fe. The industrial pure iron was composed of 0.300% by weight of C, 0.020% by weight of Si, 0.150% by weight of Mn, and Fe. The ferromanganese was composed of 6.410% by weight of C, 1.630% by weight of Si, 65.900% by weight of Mn, and Fe. The ferrosilicon was composed of 0.100% by weight of C, 73.100% by weight of Si, and Fe. The pig iron was composed of 4.270% by weight of C, 0.900% by weight of Si, 0.113% by weight of Mn, and Fe. The ferrochromium was composed of 0.240% by weight of C, 59.300% by weight of Cr, 1.700% by weight of Si, and Fe. The ferroboron was composed of 0.320% by weight of C, 0.760% by weight of Si, 18.350% by weight of B, and Fe. The ferrotungsten was composed of 0.060% by weight of C, 0.290% by weight of Si, 0.160% by weight of Mn, 77.840% by weight of W, and Fe. The ferromolybdenum was composed of 0.034% by weight of C, 0.750% by weight of Si, 61.000% by weight of Mo, and Fe. The ferrovanadium was composed of 0.310% by weight of C, 1.010% by weight of Si, 52.020% by weight of V, and Fe. The ferrotitanium was composed of 0.002% by weight of C, 0.015% by weight of Si, 26.460% by weight of Ti, and Fe.

The directionally solidified high-speed steel was prepared as follows.

(S1) The scrap steel, the pig iron, the industrial pure iron, the ferromolybdenum, the ferrochromium, the ferrotungsten, the ferrovanadium, the ferromanganese and the ferrosilicon were fed to a furnace in sequence and molten to obtain a first melt, which was transferred to a ladle. When the furnace was heated to 1600° C., the ferroboron and ferrotitanium were fed to the furnace and molten, and the first melt in the ladle was transferred back to the furnace to obtain a second melt, which was then transferred to the ladle. After that, 0.152 g of the aluminum filament was fed to a bottom of the furnace to perform deoxidization, and then the second melt in the ladle are transferred back to the furnace and subjected to refinement by argon blowing at the bottom of the furnace for 15 min to obtain a liquid steel, which was confirmed to be qualified and clean. Subsequently, the liquid steel was subjected to superheating treatment at 1510° C. for 12 min with a superheating degree of 50.2° C. Before casting, the sodium silicate-bonded sand mold was dried at 280° C. for 8 h.

(S2) The liquid steel obtained in step (S1) was poured into the directional solidification device at a temperature of 1440° C. for directional solidification, where the temperature measurement was enabled by means of a thermal couple, and a chilling block formed by embedding a copper block in a pure iron was employed for cooling; and a thickness of a coating layer was 1.1 mm. Before the casting, skimming and deoxidation were performed, and a thermal insulation agent (high-purity perlite) was spread uniformly on the casting riser of the directional solidification device. The solidification was performed at a cooling rate of 12.3° C./s for 21.0 s. After cooled to room temperature, the resulting solidified product was subjected to mold dismantling, shakeout, wire cutting, and finishing to obtain the directionally solidified high-boron and high-vanadium high-speed steel.

Referring to an embodiment of the directional solidification device illustrated in FIG. 1, four lateral built-in thermocouples were arranged in the same level 5 mm away from the bottom of the cold end for temperature measurement, and a composite cooling system formed by a pure iron block and a small copper block embedded in the bottom thereof was employed. The pure iron block was 300 mm×300 mm×300 mm in size, and the copper block was 150 mm×150 mm×200 mm in size and arranged in the pure iron block with the bottom centerline 100 mm away from the top surface of the pure iron. The pure iron was closely fitted with the copper block, which improves the cooling rate of the casting and facilitates the formation of an ideal directionally solidified columnar crystal structure under a desired temperature gradient.

As shown in FIGS. 2*a-f*, directionally solidified high-boron high-speed steels respectively with 0.00 wt. %, 1.00 wt. % and 2.05 wt. % of V were compared with respect to the optical topography. It could be seen that in the selected three levels of V (0.00 wt. %, 1.00 wt. %, and 2.05 wt. %), the substrate exhibited an obvious columnar crystal structure growing along the direction of heat flow, and thus the resulting alloy products all had good orientation effect. In the presence of 2.05 wt. % V, the alloy had an evenly distributed hard phase and a fine structure without segregation, and reached the optimal orientation effect and vanadium refinement effect.

Figure 3:
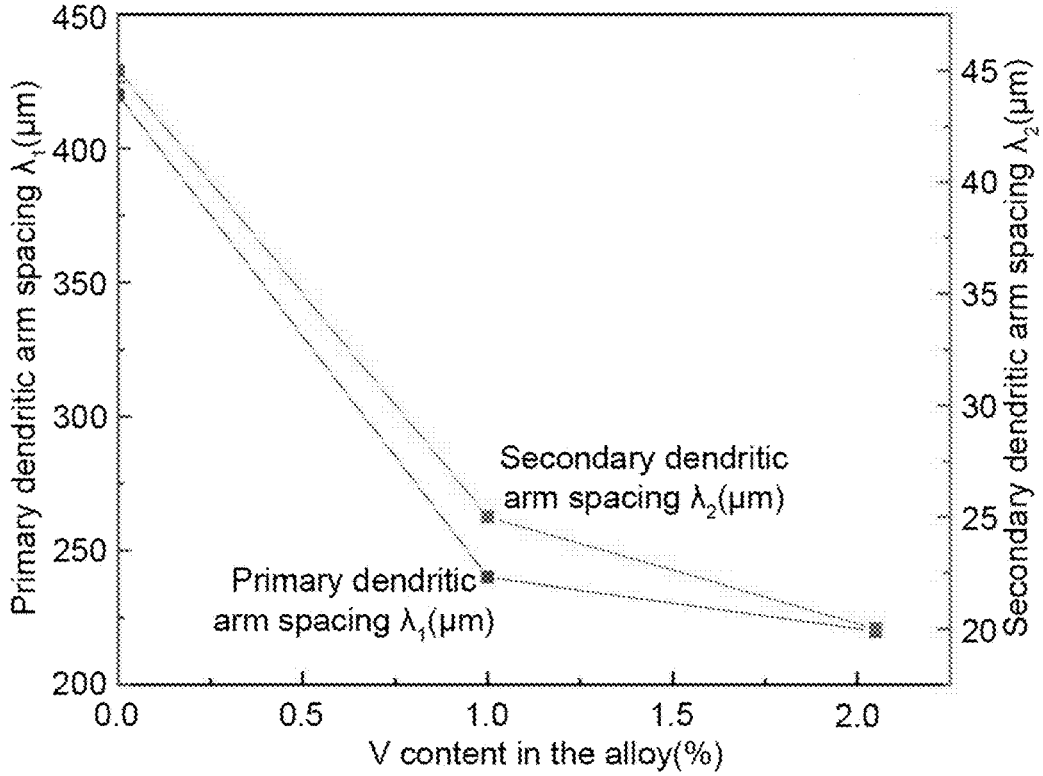
FIG. 3 shows statistical results of a primary dendrite arm spacing and a secondary dendrite arm spacing in the presence of different levels of vanadium.

Referring to FIG. 3, with respect to the columnar crystal matrix (V content<2.05 wt. %), the primary dendrite arm spacing and the secondary arm dendrite spacing decreased with the increase of V content. When the V content was 2.05 wt. %, the minimum primary dendrite arm spacing and secondary dendrite arm spacing of columnar crystal were 220 μm and 20 μm, respectively, which were reduced by 52.38% and 44.45%, respectively, compared with those of the high-boron vanadium-free high-speed steel.

The primary dendrite arm spacing and the secondary dendrite arm spacing of samples varying in the vanadium level were shown in Table 1.

TABLE 1

Primary and secondary dendrite arm spacings of steels with different V contents

| V Content (wt. %) | Primary dendrite arm spacing (μm) | Secondary dendrite arm spacing (μm) |
|---|---|---|
| 0.00 | 420 | 45 |
| 1.00 | 240 | 25 |
| 2.05 | 220 | 20 |

The bulk hardness and bending strength of directionally solidified high-boron high-speed steels varying in V content (0.00 wt. %, 1.00 wt. % and 2.05 wt. %) were tested and compared.

Figure 4:
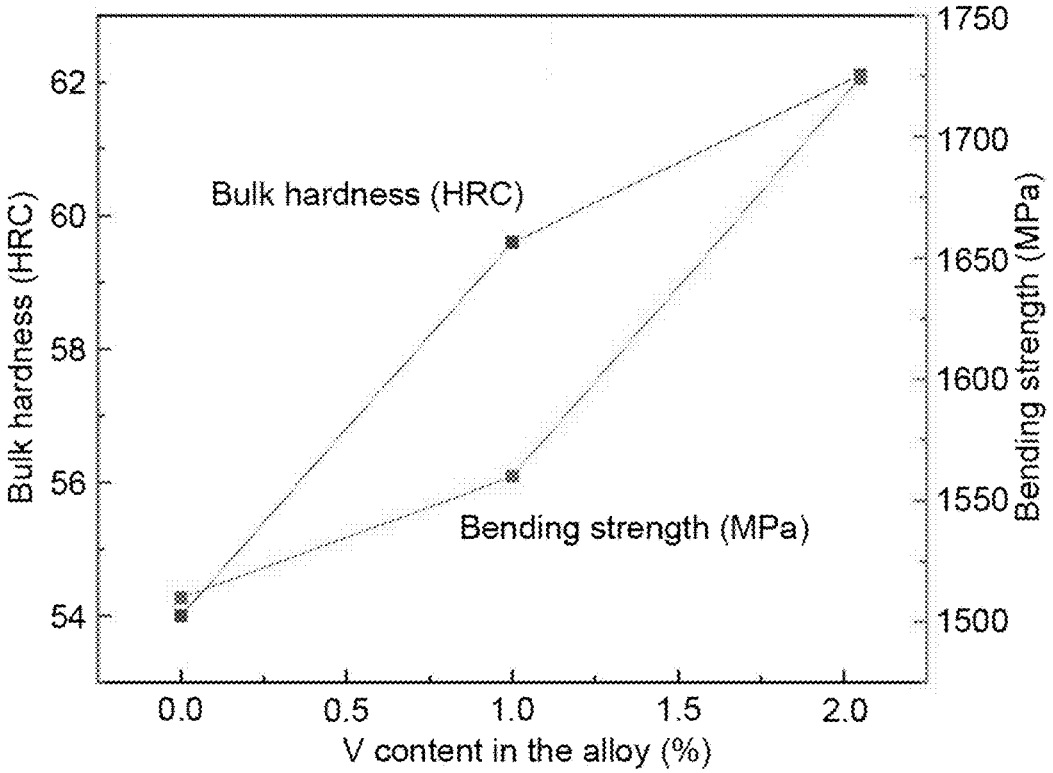
FIG. 4 shows macro-hardness and bending strength test results of the high-boron high-vanadium high-speed steels varying in the vanadium content.

Referring to FIG. 4, the bulk hardness of the alloy increased with the increase of vanadium content. In particular, in the presence of 2.05 wt. % vanadium, the alloy hardness of the vertical hard phase cylinder reached the maximum 62.1 HRC, which was 13.04% higher than that of the as-cast high-boron high-speed steel, and 35.42% higher than that of the as-cast high-boron high-speed steel bearing 0.4% by weight of C, 2.0% by weight of B, and 1.0% by weight of V (40.1 HRC). At the same time, the toughness of the alloy was improved by 32%. In addition, the bending strength of the alloy was also enhanced with the increase of the vanadium content, and when the vanadium content was 2.05 wt. %, the bending strength of the parallel hard phase cylinder reached the maximum 1724 MPa, which was 12.41% higher than that of the as-cast high-speed steel. The bulk hardness results of steels were shown in Table 2.

TABLE 2 bulk hardness of cross section of steels with different V contents

| V content (wt. %) | Hardness (HRC) |
|---|---|
| 0.00 | 54.0 |
| 1.00 | 59.6 |
| 2.05 | 62.1 |
| As-cast high-boron high-speed steel containing 0.4% C, 2.0% B, and 1.0% V | 40.1 |

The test results of bending strength were shown in Table 3.

TABLE 3

Bending strength of steels with different V contents

| V content (wt. %) | Bending strength (MPa) |
|---|---|
| 0.00 | 1510 |
| 1.00 | 1560 |
| 2.05 | 1724 |

Overall, by using the method provided herein for preparing the directionally solidified high-speed steel, the prepared high-speed steel has a good orientation effect. In the presence of 2.05 wt. %, the obtained alloy has an evenly distributed hard phase, a fine structure without segregation, and shows the best orientation effect and vanadium refinement effect. The minimum primary dendrite arm spacing and the secondary dendrite arm spacing of the alloy columnar crystal are 220 μm and 20 μm, which are reduced by 52.38% and 44.45%, respectively, compared with those of the high-boron vanadium-free high-speed steel. The alloy hardness and the bending strength are increased by 13.04% and 12.41%, respectively. As a result, the directionally solidified high-speed steel provided herein has an evenly distributed hard phase, a fine structure without segregation, and a high hardness and bending strength. The method provided herein is low-cost and offers a new idea for developing the wear-resistant high-speed steel In summary, by means of the directional solidification process, the grain orientation of the solidified microstructure can be better controlled such that the high-speed steel presents a certain orientation and has a continuous columnar crystal structure, allowing for greatly improved performance compared with the ordinary high-boron high-speed steel.

Described above are merely illustrative of the technical solutions of the present disclosure, and are not intended to limit the present disclosure. It should be understood that all changes, replacements and modifications made by those skilled in the art on the basis of the technical solutions proposed herein without departing from the scope of the disclosure shall fall within the scope of the present disclosure defined by the appended claims.

What is claimed is:

1. A method of preparing a directionally solidified steel, comprising:

(S1) subjecting a raw material to smelting at 1580-1600° C. and refining to obtain a liquid steel; wherein the raw material comprises pig iron, scrap steel, ferrochromium, ferromanganese, ferroboron, a ferrovanadium, industrially pure iron, ferromolybdenum, ferrotungsten, ferrosilicon and ferrotitanium; and (S2) subjecting the liquid steel to superheating and directional solidification at a casting temperature of 1420-1430° C. followed by cooling to room temperature to obtain the directionally solidified steel;

wherein the directional solidification is performed in a directional solidification device equipped with a sodium silicate-bonded sand mold as a casting mould; an inner side surface of the sodium silicate-bonded sand mold is coated with an aluminum oxide coating with an average thickness of 0.8-1.1 mm; and in step (S2), before the directional solidification, the sodium silicate-bonded sand mold is dried at 250-280° C. for 6-8 h.

2. The method of claim 1, wherein in step (S1), the raw material comprises 4.893-4.894% by weight of the pig iron, 25.176-25.177% by weight of the scrap steel, 8.520-8.521% by weight of the ferrochromium, 1.038-1.039% by weight of the ferromanganese, 10.899-10.900% by weight of the ferroboron, 4.148-4.149% by weight of the ferrovanadium, 41.850-41.860% by weight of the industrially pure iron, 1.121-1.122% by weight of the ferromolybdenum, 1.554-1.555% by weight of the ferrotungsten, 0.463-0.464% by weight of the ferrosilicon and 0.335-0.336% by weight of the ferrotitanium.

3. The method of claim 1, wherein in step (S1), the smelting and the refining are performed through steps of:

feeding the scrap steel, the pig iron and the industral industrially pure iron to a furnace, and then feeding the ferromolybdenum, the ferrochromium, the ferrotungsten, the ferrovanadium, the ferromanganese and the ferrosilicon to the furnace; heating the furnace to 1550-1600° C. to obtain a first melt; transferring the first melt with a ladle;

feeding the ferroboron and the ferrotitanium to the furnace and then transferring the first melt in the ladle back to the furnace to obtain a second melt; transferring the second melt to the ladle; introducing 0.148-0.152 g of an aluminum filament to a bottom of the furnace for deoxidization; transferring the second melt back to the furnace; and performing argon blowing at the bottom of the furnace for 8-15 min for refining.

4. The method of claim 1, wherein in step (S2), the superheating of the liquid steel is performed at 1510-1520° C. for 10-12 min with a superheat degree of 49.8-50.2° C.

5. The method of claim 1, wherein in step (S2), a top end of a casting riser of the directional solidification device is spread with a thermal insulating agent; the directional solidification device is performed at a cooling rate of 12.1-12.3°

C./s for 19.0-21.0 s; and after cooled down to a room temperature, the directionally solidified steel is subjected to mold dismantling, shakeout and wire cutting.

6. The method of claim 5, wherein the directional solidification device adopts a thermal-couple for heating monitor.

7. The method of claim 6, wherein the casting mould of the directional solidification device is coated with a coating layer having a thickness of 0.8-1.1 mm.

* * * * *